US011076653B2

(12) United States Patent
Houston et al.

(10) Patent No.: US 11,076,653 B2
(45) Date of Patent: Aug. 3, 2021

(54) HAT SHOWING A MESSAGE OR A LOGO THROUGH A CUTOUT

(71) Applicants: Kenny Houston, Shreveport, LA (US); Cassandra D. Montgomery, Shreveport, LA (US)

(72) Inventors: Kenny Houston, Shreveport, LA (US); Cassandra D. Montgomery, Shreveport, LA (US)

(73) Assignees: Kenny Houston, Shreveport, LA (US); Cassandra D. Montgomery, Shreveport, LA (US)

( * ) Notice: Subject to any disclaimer, the term of this patent is extended or adjusted under 35 U.S.C. 154(b) by 1 day.

(21) Appl. No.: 15/906,952

(22) Filed: Feb. 27, 2018

(65) Prior Publication Data

US 2019/0059489 A1 Feb. 28, 2019

Related U.S. Application Data

(63) Continuation-in-part of application No. 29/615,668, filed on Aug. 30, 2017, now Pat. No. Des. 871,028, which is a continuation-in-part of application No. 29/615,672, filed on Aug. 30, 2017, now Pat. No. Des. 843,694.

(51) Int. Cl.

| | |
|---|---|
| ***A42B 1/00*** | (2006.01) |
| ***A42B 1/06*** | (2006.01) |
| ***A42B 1/004*** | (2021.01) |
| ***A42B 1/0182*** | (2021.01) |

(52) U.S. Cl.

CPC ..... *A42B 1/004* (2013.01); *A42B 1/0182* (2021.01)

(58) Field of Classification Search

CPC ..... A42B 1/004; A42B 1/062
USPC ..... 2/175.1, 195.1; 40/586, 329
See application file for complete search history.

(56) References Cited

U.S. PATENT DOCUMENTS

| | | | | | |
|---|---|---|---|---|---|
| 1,274,652 | A | | 8/1918 | Winget | |
| 1,753,052 | A | | 4/1930 | Lake | |
| D111,267 | S | | 9/1938 | Scheiwiller | |
| 2,377,645 | A | | 6/1945 | Peffer | |
| 2,416,062 | A | | 2/1947 | Mercer | |
| 2,803,829 | A | * | 8/1957 | Tscharner | A42B 1/004 40/329 |
| D248,893 | S | | 8/1978 | Comensoli et al. | |
| 4,292,689 | A | | 10/1981 | Townsend, Jr. | |
| 4,335,471 | A | | 6/1982 | Quigley, Jr. et al. | |
| 4,546,496 | A | | 10/1985 | Lewis | |
| 4,945,575 | A | | 8/1990 | Townsend | |
| 5,253,368 | A | * | 10/1993 | Blake | A42B 1/248 2/195.1 |
| 5,275,419 | A | * | 1/1994 | Kazemi | A42B 1/004 2/195.1 |
| D349,596 | S | | 8/1994 | Booth | |
| 5,410,761 | A | | 5/1995 | Connelly et al. | |
| 5,425,620 | A | | 6/1995 | Stroud | |

(Continued)

OTHER PUBLICATIONS

Office Action dated Jan. 24, 2020 in U.S. Appl. No. 16/112,591, pp. 11.

*Primary Examiner* — Gloria M Hale
(74) *Attorney, Agent, or Firm* — Ichthus International Law PLLC

(57) ABSTRACT

A cap including at least one panel and a brim having an opening in a shape of at least one of an advertisement, a logo, a design, a statement, a phrase, an emblem of a sports team, company, or organization.

6 Claims, 4 Drawing Sheets

(56) References Cited

U.S. PATENT DOCUMENTS 5,465,426 A * 11/1995 Beaton ..... A42B 1/248 2/181
5,487,191 A 1/1996 Ridley
D369,096 S 4/1996 Perrin et al.
5,548,847 A * 8/1996 Spicijaric ..... A42B 1/248 2/181
D374,331 S 10/1996 Duggan
5,647,060 A 7/1997 Lee
5,729,833 A 3/1998 Judge
5,742,944 A 4/1998 Pfefferman
5,815,841 A * 10/1998 Spangrud ..... A42B 1/004 2/195.1
D400,341 S 11/1998 House
5,920,913 A 7/1999 Brandon
5,943,698 A * 8/1999 Blanks, I ..... G09F 21/02 2/115
6,044,492 A * 4/2000 Krogh ..... A41D 27/08 2/113
D430,403 S 9/2000 Baik
6,170,088 B1 1/2001 Tate
6,240,568 B1 * 6/2001 Lee ..... A41D 27/08 2/195.1
6,418,562 B1 7/2002 Shwartz
6,457,183 B1 10/2002 Perry
6,470,499 B1 * 10/2002 Joiner ..... A41D 27/08 2/115
6,986,166 B2 1/2006 Cho
D550,931 S 9/2007 Valcourt
7,454,799 B2 11/2008 Wuensche et al.
D592,835 S * 5/2009 Wilson ..... D2/893
D601,329 S * 10/2009 Johns ..... D2/876
D617,981 S * 6/2010 Hines ..... D2/893
D622,488 S 8/2010 McClaskie
D622,491 S 8/2010 McClaskie
D641,424 S 7/2011 Bengyak
8,726,420 B1 5/2014 Uitermarkt
8,763,163 B1 7/2014 Johns
D741,050 S 10/2015 Bell
D843,694 S 3/2019 Houston et al.
D849,370 S 5/2019 Garcia et al.
2004/0079011 A1 * 4/2004 Shwartz ..... G09F 3/20 40/329
2004/0231033 A1 11/2004 Cho
2006/0117462 A1 * 6/2006 Wysopal ..... A42B 1/24 2/209.13
2007/0006502 A1 * 1/2007 Schmelzer ..... A44B 1/32 40/636
2007/0022516 A1 2/2007 Wuensche
2007/0061937 A1 3/2007 Curle
2007/0271679 A1 * 11/2007 Wysopal ..... A42B 1/24 2/209.13
2008/0072466 A1 * 3/2008 Fenner ..... G09F 3/16 40/329
2008/0222777 A1 9/2008 Schneider
2009/0100559 A1 4/2009 Christian
2010/0299979 A1 * 12/2010 LaMere ..... A42B 1/248 40/329
2011/0067168 A1 3/2011 Steiner
2012/0096625 A1 4/2012 Sarazin
2014/0304889 A1 * 10/2014 Oh ..... A42B 1/064 2/175.1
2015/0033444 A1 2/2015 Heard
2015/0164167 A1 6/2015 Gayer
2016/0219962 A1 8/2016 Abers

* cited by examiner

HAT SHOWING A MESSAGE OR A LOGO THROUGH A CUTOUT

CROSS-REFERENCE TO RELATED APPLICATION

This application claims the benefit of Design U.S. patent application Ser. Nos. 29/615,668 and 29/615,672, both filed on Aug. 30, 2017, the content of which are expressly incorporated herein by reference thereto.

FIELD OF THE INVENTION

The present disclosure generally relates to a hat or a cap that displays a particular insignia, such as an advertisement, logo, design, or emblem of a sports team, company, or organization, through a cutout in the brim, visor, or bill portion of the hat or cap.

BACKGROUND OF THE INVENTION

The existing caps include an advertisement, logo, design, or emblem of a sports team, company, or organization swan, stitched, or adhered into one of more panels of the cap. In some caps, the advertisement, logo, design, or emblem of a sports team, company, or organization can be positioned on one or more panels of the cap and extend into the brim, visor, or bill portion of the cap or hat.

SUMMARY OF THE INVENTION

In an aspect, a cap includes at least one panel and a brim having an opening in a shape of at least one of an advertisement, a logo, a design, a statement, a phrase, an emblem of a sports team, company, or organization.

In another aspect, the opening is positioned off-center of the brim.

In yet another aspect, the opening includes a depth that is the same as the thickness of the brim.

In a further aspect, the brim creates a shaded area that covers at least a portion of the user's face and wherein the opening is positioned such that light passing through the opening creates an image of the opening on the face of the user.

In an aspect, the opening is in a shape of a handgun.

In another aspect, the opening is in a shape of a cannabis leaf.

In yet another aspect the at least one panel includes at least a statement and a design.

In a further aspect, the at least one panel includes at least one of an advertisement, a logo, a design, a statement, a phrase, an emblem of a sports team, company, or organization that is in a shape of the opening.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

BRIEF DESCRIPTION OF THE DRAWINGS

The present disclosure in its several aspects and embodiments can be more fully understood from the detailed description and the accompanying drawings, wherein.

Throughout this specification and figures like reference numbers identify like elements.

DETAILED DESCRIPTION OF THE INVENTION

Figure 1:
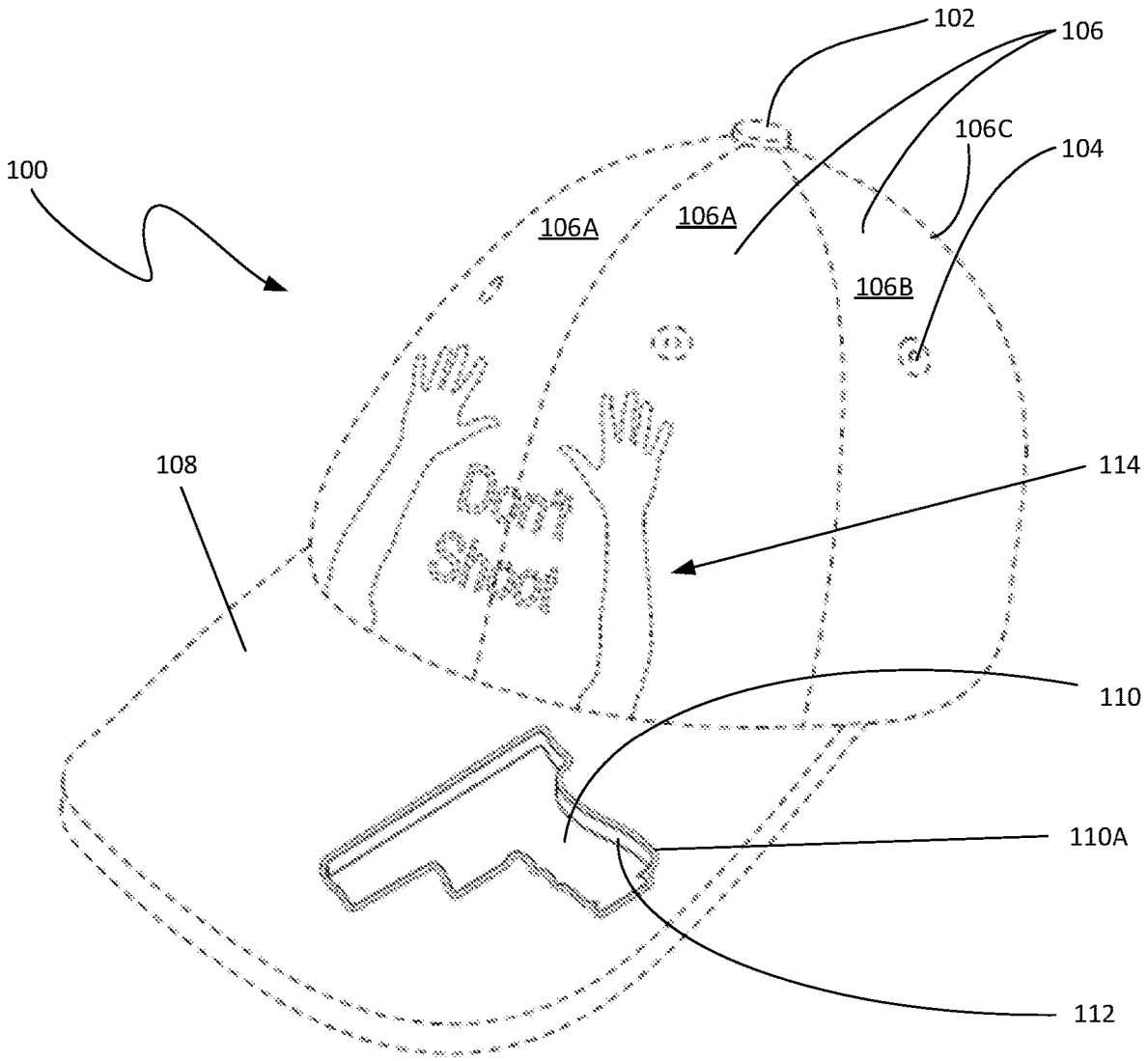
FIG. 1 is a perspective view of a hat having a gun-shape cutout, according to an example of the present disclosure.

It is to be understood that both the foregoing general description and the following detailed description are exemplary and explanatory only, and are intended to provide an explanation of various embodiments of the present teachings.

In the drawings and in the description that follows, the terms "brim," "visor," or "bill" refers to the portion of the cap that protrudes outward (to shade the eyes from sunlight and to keep rain off the face) and are used interchangeably.

In its broad and varied embodiments, disclosed herein is a cap 100, as shown in FIGS. 1-4. The cap 100 can include an optional top button 102; a plurality of panels 106, an eyelet 104 on each of the plurality of panels 106, and a brim 108. Generally, the plurality of panels 106 can include two front panels 106A, two side panels 106B, and two back panels 106C.

In an example, the brim 108 can include an opening 110 in a shape of an advertisement, a logo, a design, a statement, a phrase, an emblem of a sports team, company, or organization. For example, as shown in FIGS. 1 and 3, the shape of the opening can be substantially similar to a shape of a handgun 110A. In another example, as shown in FIGS. 2 and 4, the shape of the opening can be substantially similar to a shape of a cannabis leaf 110B.

In an example, as shown in FIGS. 1-4, the opening can be positioned off-center of the brim 108. Furthermore, the opening can include a depth 112 that is the same as the thickness of the brim. Accordingly, light can enter the opening at the top portion of the brim 108 and exit the brim at the bottom portion of the brim 108.

In an example, the brim 108 creates a shaded area that covers at least a portion of the user's face. Given that the opening extends all the way though the thickness of the brim 108, when the light passes though the opening 110, it can reflect the shape of the opening on the face of the user.

Figure 2:
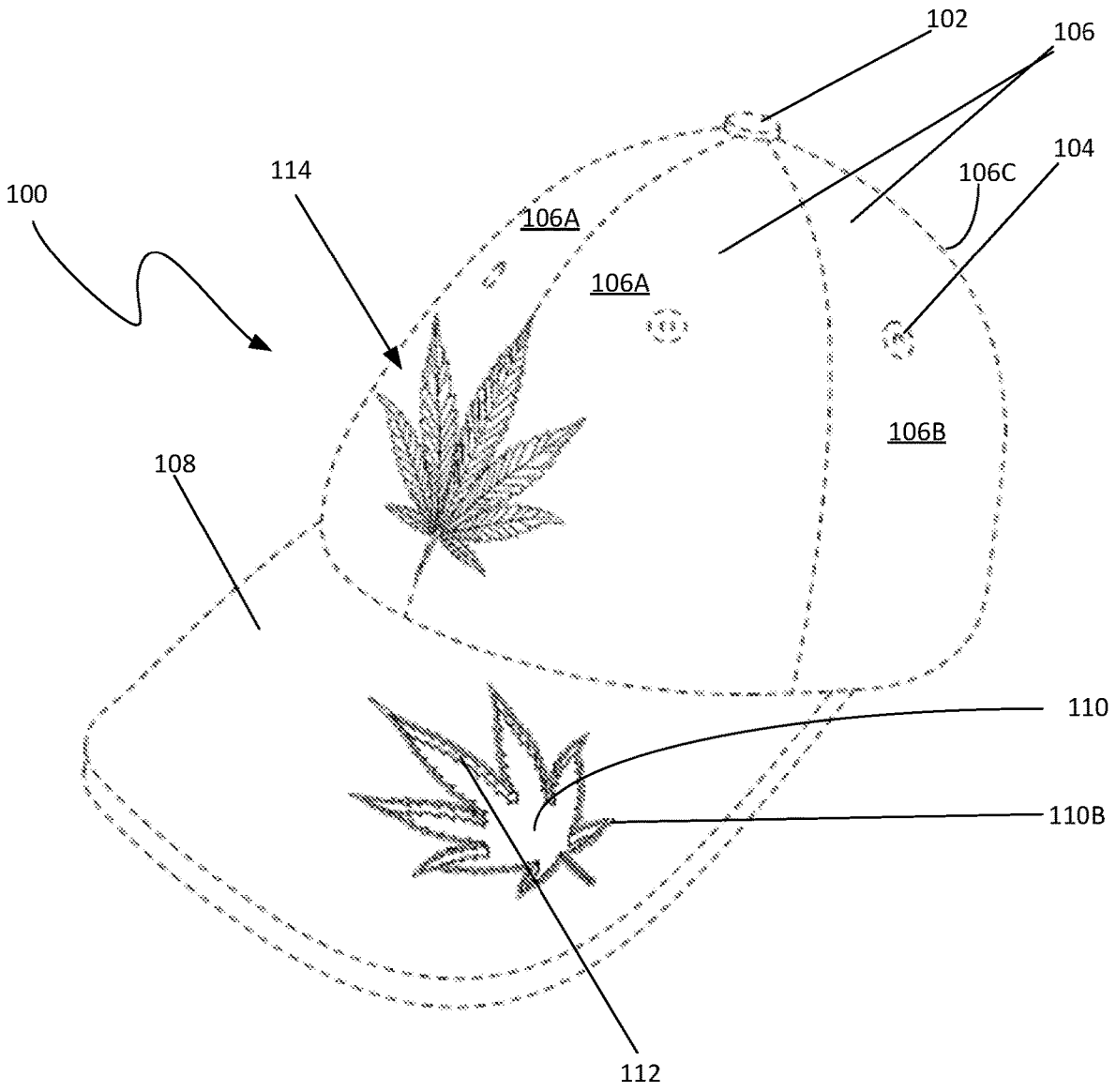
FIG. 2 is a perspective view of a hat having a cannabis leaf cutout; according to another example of the present disclosure.
Figure 3:
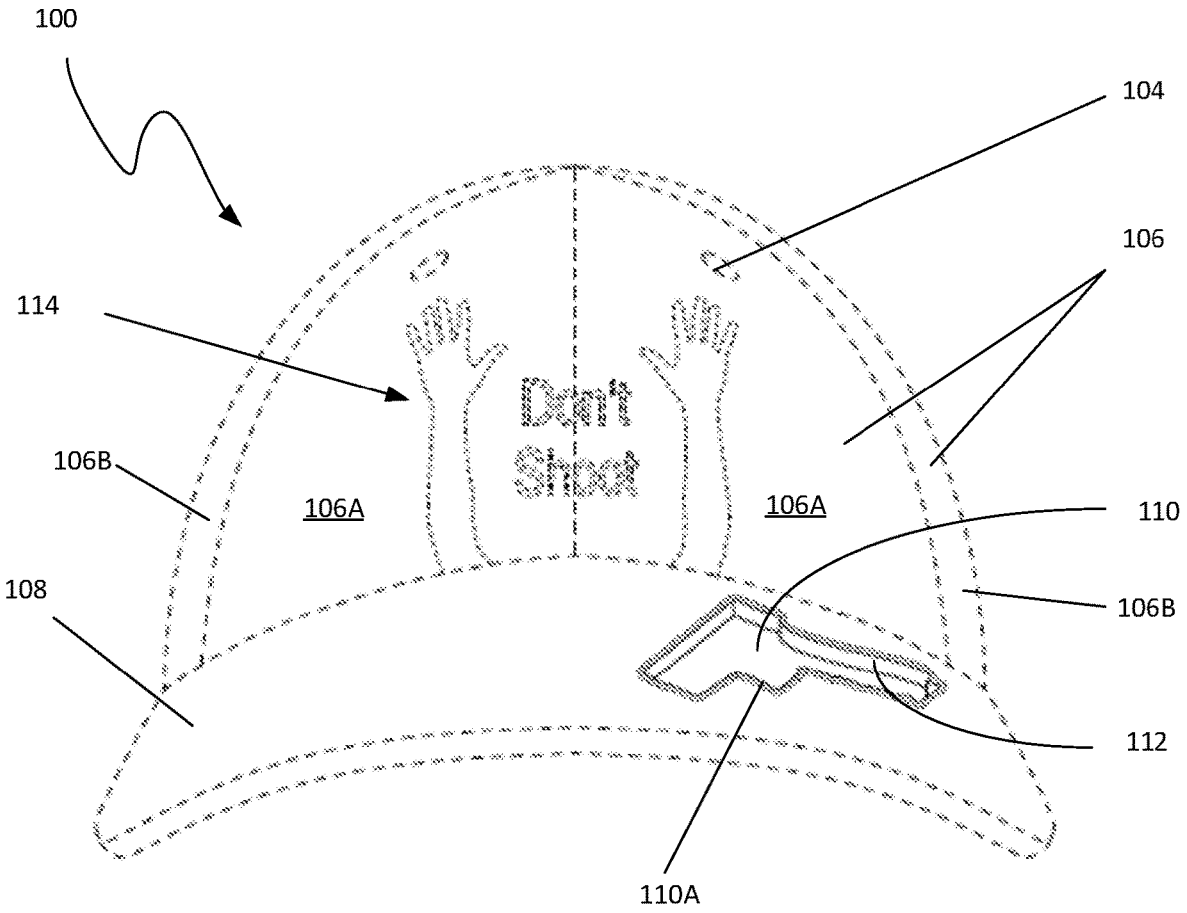
FIG. 3 is a front view of FIG. 1.
Figure 4:
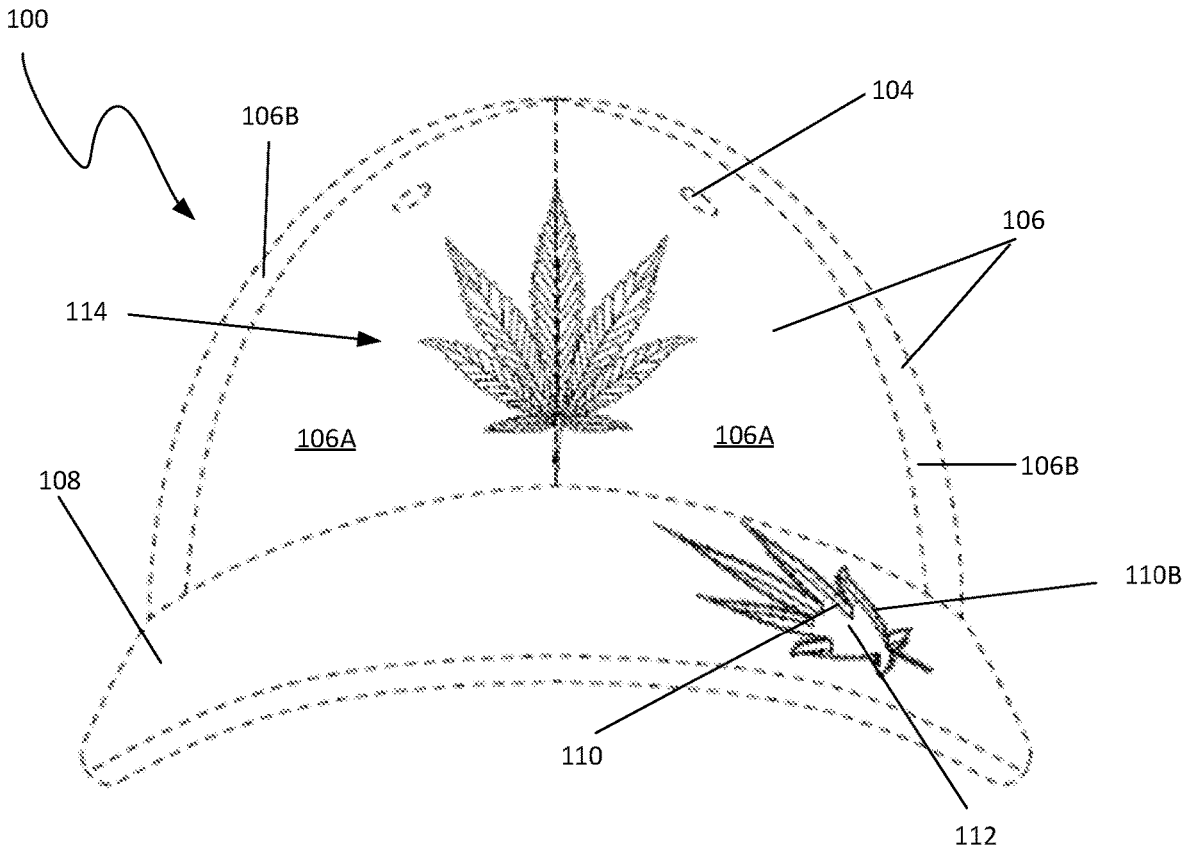
FIG. 4 is a front view of FIG. 2.

In an example, as shown in FIGS. 1-4, the panels 106, such as panels 106A can include at least one an advertisement, a logo, a design, a statement, a phrase, an emblem of a sports team, company, or organization. As shown in FIGS. 1 and 3, the panels 106A can include a design and a statement or a phrase that is related to the opening 110. For example, as shown in FIGS. 1 and 3, when the opening 110 includes a shape of a handgun 110A, the design and phrase on the front panels 106A can be two arms sticking up and the phrase "Don't Shoot." In another example, as shown in FIGS. 2 and 4, the design on the front panel 106A can be substantially similar to the design of the opening 110. For example, when the design of the opening 110 includes a shape of a cannabis leaf 110B, the design on the front panels 106A can be a cannabis leaf as well.

From the foregoing description, those skilled in the art can appreciate that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

This scope disclosure is to be broadly construed. It is intended that this disclosure disclose equivalents, means, systems and methods to achieve the devices, activities and mechanical actions disclosed herein. For each device, article, method, mean, mechanical element or mechanism disclosed, it is intended that this disclosure also encompass in its disclosure and teaches equivalents, means, systems and methods for practicing the many aspects, mechanisms and devices disclosed herein. This disclosure is intended to encompass the equivalents, means, systems and methods of the use of the device and/or article of manufacture and its many aspects consistent with the description and spirit of the operations and functions disclosed herein. The claims of this application are likewise to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

We claim:

1. A cap for a user, the cap comprising:

at least one panel; and a brim coupled to the at least one panel and having an opening in a shape of at least one of an advertisement, a logo, a statement, a phrase, an emblem of a sports team, company, or organization, wherein the brim is configured to create a shaded portion for display on a face of the user wearing the cap, wherein when light passes through the opening of the brim, a lighted portion within at least a portion of the shaded portion is created upon the face of the user wearing the cap by the light passing through the opening and shining upon the face of the user wearing the cap, wherein the lighted portion corresponds to the shape of the opening including the at least one of an advertisement, a logo, a statement, a phrase, or an emblem of a sports team, company or organization, and wherein the at least one panel is configured to include a statement or a phrase that is related to the shape of the opening of the brim including the at least one of the advertisement, the logo, the statement, the phrase, or the emblem of the sports team, company or organization.

2. The cap of claim 1, wherein the opening is positioned off-center of the brim.

3. The cap of claim 1, wherein the opening includes a thickness that is equal to a thickness of the brim.

4. The cap of claim 1, wherein the opening is in a shape of a handgun.

5. The cap of claim 1, wherein the opening is in a shape of a cannabis leaf.

6. The cap of claim 1, wherein the opening of the at least one panel includes at least a statement and a design.

* * * * *